US007770544B2

(12) United States Patent
Viskup, Jr.

(10) Patent No.: US 7,770,544 B2
(45) Date of Patent: Aug. 10, 2010

(54) HEAT RECOVERY STEAM GENERATOR

(75) Inventor: John C. Viskup, Jr., Owasso, OK (US)

(73) Assignee: Victory Energy Operations LLC, Collinsville, OK (US)

( * ) Notice: Subject to any disclaimer, the term of this patent is extended or adjusted under 35 U.S.C. 154(b) by 715 days.

(21) Appl. No.: 11/288,667

(22) Filed: Nov. 29, 2005

(65) Prior Publication Data

US 2006/0144348 A1 Jul. 6, 2006

Related U.S. Application Data

(60) Provisional application No. 60/632,697, filed on Dec. 1, 2004.

(51) Int. Cl.
*F22B 37/14* (2006.01)

(52) U.S. Cl. ..... 122/235.19; 122/367.1; 122/367.3

(58) Field of Classification Search ..... 122/367.1, 122/367.3, 235.19, 235.11, 235.21, 235.15, 122/235.17, 235.29, 235.34, 240.3
See application file for complete search history.

(56) References Cited

U.S. PATENT DOCUMENTS

| | | | | | |
|---|---|---|---|---|---|
| 1,795,383 | A * | 3/1931 | Brunt | 122/235.11 |
| 3,200,793 | A * | 8/1965 | Cleaver | 122/240.1 |
| 3,254,634 | A * | 6/1966 | Vorkauf | 122/235.11 |
| 3,266,566 | A * | 8/1966 | Huet | 165/145 |
| 3,703,161 | A * | 11/1972 | O'Connor | 122/235.11 |
| 4,013,877 | A * | 3/1977 | Uram et al. | 700/6 |
| 4,501,233 | A | 2/1985 | Kusaka | |
| 5,005,529 | A * | 4/1991 | Polcer | 122/235.15 |
| 5,273,002 | A * | 12/1993 | Balint et al. | 122/20 B |
| 5,318,109 | A * | 6/1994 | Yamada et al. | 165/135 |
| 5,490,559 | A * | 2/1996 | Dinulescu | 165/148 |
| 5,575,244 | A * | 11/1996 | Dethier | 122/406.1 |
| 5,730,088 | A | 3/1998 | Foley et al. | |
| 5,881,551 | A | 3/1999 | Dang | |
| 5,924,389 | A | 7/1999 | Palkes et al. | |
| 6,092,490 | A | 7/2000 | Bairley et al. | |
| 6,340,002 | B1 | 1/2002 | Liebig | |
| 6,352,054 | B1 * | 3/2002 | Yamada et al. | 122/367.1 |
| 6,557,500 | B1 * | 5/2003 | Schroeder | 122/7 R |
| 6,957,630 | B1 | 10/2005 | Mastronarde | |
| 7,347,059 | B2 * | 3/2008 | Kidwell et al. | 62/260 |
| 2004/0069244 | A1 * | 4/2004 | Schroeder | 122/406.4 |
| 2006/0144348 | A1 * | 7/2006 | Viskup | 122/235.15 |

* cited by examiner

*Primary Examiner*—Gregory A Wilson
(74) *Attorney, Agent, or Firm*—Kelley Drye & Warren LLP

(57) ABSTRACT

In accordance with one embodiment of the present invention, a first vessel for holding a mixture of steam and water is disclosed. At least one first manifold is in fluid communication with the first vessel, the at least one first manifold is for receiving water from the first vessel. At least one second manifold is in fluid communication with the first vessel and in parallel spaced relation to the first manifold, the at least one second manifold is for returning a mixture of steam and water to the first vessel. At least one tube is in fluid communication with the at least one first manifold and the at least one second manifold, and a plurality of fins extends radially outward from an outer surface of the at least one tube.

47 Claims, 8 Drawing Sheets

HEAT RECOVERY STEAM GENERATOR

CROSS-REFERENCE TO RELATED APPLICATIONS

This application claims the benefit of priority of U.S. Provisional Patent Application No. 60/632,697, entitled "HEAT RECOVERY STEAM GENERATOR," filed Dec. 1, 2004, which is herein incorporated by reference in its entirety.

BACKGROUND OF THE INVENTION

The present invention relates to steam generators and more specifically to an improved heat recovery steam generator ("HRSG").

Heat recovery steam generators have been used to recover heat from various processes that result in high temperature exhaust gases. The hot exhaust gases are passed through the heat recovery steam generator, which has a variety of heat exchanging surfaces to further process the excess thermal energy contained in the exhaust gases. As exhaust gases pass through the heat recovery steam generator, the heat from the exhaust gases is transferred by the heat exchanging surfaces to fluid, such as water, passing through the system. The fluid absorbs the heat from the exhaust gases, and a portion of the fluid is converted into steam. The steam is then removed from the heat recovery steam generator and may be used to perform work in other processes. For example, the steam may be used to propel turbines, such as those used in electrical power production. Additionally, the heat recovery steam generator may have gas or oil-fired burners to further combust the exhaust gases. As a result, the amount of steam generated can be significantly increased, thereby maximizing the amount of work that can be performed.

As an example, a typical heat recovery steam generator includes a plurality of boiler tubes that serve as the heat exchanging surfaces within the device. Fluid such as water circulates through the boiler tubes. As the hot exhaust gases pass through the heat recovery steam generator, the heat from the exhaust gases is transferred through the boiler tubes and is absorbed by the fluid circulated within the tubes. A portion of the fluid is converted into steam, which is then removed from the heat recovery steam generator and used to perform work in other processes such as electrical power production.

Heat recovery steam generators have been used in tandem with various other devices that produce high temperature exhaust gases. For example, heat recovery steam generators may be used in tandem with gas turbines to further process the exhaust gases, thereby improving the overall efficiency and reducing the fuel requirements of the power production process. The exhaust gases exiting from gas turbines are extremely hot (typically 800° to 1000° F.) and oxygen rich (75 to 80 percent of that typically found in atmospheric air), meaning that they still possess recoverable thermal energy. In a time when the increasing demand for fossil fuels has driven the cost of natural gas to unprecedented levels, it is imperative that inefficiencies in power production be addressed and improved.

Heat recovery steam generators may be built on-site or factory-assembled and transported to the operating site. Heat recovery steam generators that are built on-site typically are custom designed for a specific function. On the other hand, prefabricated or "package" heat recovery steam generators, so-named because they are factory-assembled and transported to an operating site, are often designed for a wide variety of applications. As such, many conventional heat recovery steam generators are designed to maximize the flow capacity, which typically is accomplished by maximizing the size of the generator. Because most package heat recovery steam generators are shipped to the operating site via truck or rail, many conventional generators tend to be greatly oversized for most applications, thereby contributing to the inefficiency in the power production process.

Accordingly, there is a need in the art for a heat recovery steam generator that maximizes the flow capacity and efficiency of the generator. At the same time, there is a need in the art for a heat recovery steam generator that minimizes the size of the device to allow for convenient transportation. Although this invention is not limited to package heat recovery steam generators and is applicable to all types of heat recovery steam generators, it is particularly useful for package heat recovery steam generators and those designed for general purpose use.

SUMMARY OF THE INVENTION

In accordance with one embodiment of the present invention, a first vessel for holding a mixture of steam and water is disclosed. At least one first manifold is in fluid communication with the first vessel, the at least one first manifold is for receiving water from the first vessel. At least one second manifold is in fluid communication with the first vessel and in parallel spaced relation to the first manifold, the at least one second manifold is for returning a mixture of steam and water to the first vessel. At least one tube is in fluid communication with the at least one first manifold and the at least one second manifold, and a plurality of fins extends radially outward from an outer surface of the at least one tube.

DETAILED DESCRIPTION OF THE INVENTION

Figure 1:
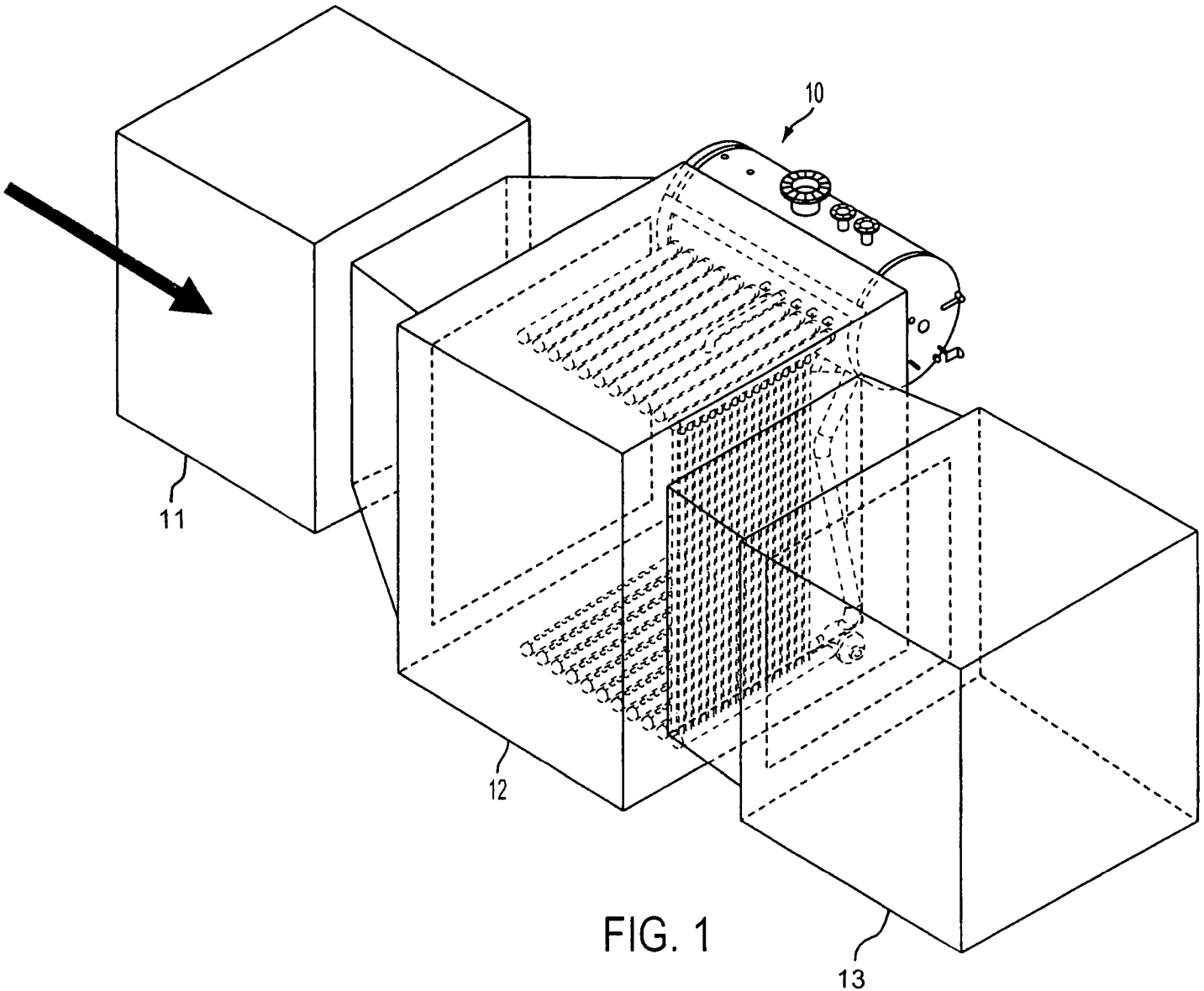
FIG. 1 is a perspective view of a heat recovery steam generator of the present invention as shown in a typical application.

It has been found that providing a finned surface to the heat exchanging tubes of a heat recovery steam generator ("HRSG") results in tremendous cost savings. Because of the finned surface, transfer thermal energy is more efficiently transferred into the tubes. As a result, fewer tubes are needed, which not only reduces the number of parts and cost of production, but also minimizes the overall dimensions of the HRSG.

HRSG preferably is used to recover heat from various processes that result in exhaust gases with temperatures up to 1750° F. Examples of such processes include those resulting from gas turbines, thermal oxidizers, fluid bed combustors, and incinerators. HRSG preferably recovers the unspent thermal energy from the exhaust gases and uses this energy to generate steam that is used to perform work in other processes. HRSG is not limited to any particular type of process or application and may be applicable to any process or application requiring steam generation. As an example, HRSG may be used to generate steam to propel a turbine used in electrical power production. As another example, HRSG may be used to heat large buildings or campuses by circulating the generated steam through a plurality of radiators disposed within the buildings.

The HRSG has a first vessel for holding the pressurized steam generated by the HRSG as well as the residual water not converted to steam during circulation through the HRSG. The residual water is contained in the first vessel until such time when the water can be re-circulated through the HRSG. During operation, the first vessel typically is partially filled about halfway with residual water, which settles on the bottom of the vessel and forces the steam to the top. The first vessel may be of any size or shape as necessary to hold the pressurized steam and residual water. While the first vessel is not limited to any particular type of vessel, one such example of the first vessel is a drum, or what is commonly referred to in the industry as a "steam drum."

The first vessel has a plurality of first inlet ports for interconnection with the heat exchanging surfaces. Additionally, the first vessel also may include one or more second inlet ports for interconnection with at least one flow enhancer, or a tube extending from the first vessel for returning steam to the first vessel, as described hereafter. The first vessel may be composed of any material suitable for holding the pressurized steam and residual water. Preferably, the first vessel is composed of metal such as carbon steel or stainless steel. It is presently preferred that the first vessel be composed of ASTM A-516, Grade 70 Carbon Steel. The first vessel may be of any size necessary for holding the pressurized steam and residual water and facilitate circulation of the fluid through the HRSG. Preferably, the first vessel has a diameter in the range of three to six feet and a length in the range of eight to twenty feet. For an HRSG capable of processing exhaust gases in the pressure range of 100 psig to 1,500 psig and of a temperature up to 1750° F., it is presently preferred that the first vessel be approximately four feet in diameter and span the width of the HRSG, or approximately eleven feet.

The first vessel may be connected to a second vessel for holding at least some of the incoming water supply. The second vessel may be of any size or shape as necessary for holding at least some of the incoming water. While the second vessel is not limited to any particular type of vessel, one such example of the second vessel is a drum, or what is commonly referred to in the industry as a "mud drum." The second vessel may be composed of any material suitable for holding at least some of the incoming water. Preferably, the second vessel is composed of metal such as carbon steel or stainless steel. It is presently preferred that the second vessel be composed of ASTM A-516, Grade 70 Carbon Steel. The second vessel may be of any size necessary for holding at least some of the incoming water used to replenish the HRSG. Preferably, the second vessel has a diameter in the range of six to fourteen inches and a length in the range of eight to twelve feet. For an HRSG capable of processing exhaust gases in the pressure range of 100 psig to 1,500 psig and of a temperature up to 1750° F., it is presently preferred that the second vessel be approximately one foot in diameter and span the width of the HRSG, or approximately eight feet.

At least one lower or first manifold is in fluid communication with the first vessel, the first manifold for receiving water from the first vessel. Additionally, at least one upper or second manifold is in fluid communication with the first vessel and in parallel spaced relation to the first manifold, the second manifold for returning a mixture of steam and water to the first vessel. The term "manifold," as used herein, is defined as "a pipe with several apertures for making multiple connections." See Webster's II New College Dictionary 666 (Houghton Mifflin, 2001). Preferably, a plurality of first manifolds and a plurality of second manifolds are in fluid communication with the first vessel.

The first and second manifolds may be composed of any material suitable for holding the pressurized steam and water up to 1750° F. Preferably, the first and second manifolds are composed of metal such as carbon steel or stainless steel. It is presently preferred that the first and second manifolds be composed of ASTM A-516, Grade 70 Carbon Steel. Additionally, any number of manifolds may be used such that there is an equal number of first manifolds corresponding with the second manifolds. For an HRSG capable of processing exhaust gases in the pressure range of 100 psig to 1,500 psig and of a temperature up to 1750° F., it is presently preferred that the HRSG have eleven first manifolds and eleven second manifolds. The first and second manifolds may be of any size necessary for achieving desired flow rates of the pressurized steam and water through the HRSG. Preferably, the first and second manifolds have a diameter in the range of six to fourteen inches and a length in the range of eight to twelve feet. For an HRSG capable of processing exhaust gases in the pressure range of 100 psig to 1,500 psig and of a temperature up to 1750° F., it is presently preferred that the first and second manifolds are each approximately four inches in diameter and span the length of the interior of the HRSG, or approximately eight feet.

A plurality of heat exchanging surfaces interconnect with the first and second manifolds. It is preferred that the heat exchanging surfaces comprise at least one tube that extends between a corresponding pair of first and second manifolds. Preferably, a plurality of tubes extend between a corresponding pair of first and second manifolds. The tubes may be of any kind or type that are suitable for holding the pressurized steam and water up to 1750° F. and facilitating the transfer of thermal energy from the exhaust gases to the pressurized steam and water circulating within, the tubes. While the tubes are not limited to any particular type, one such example of a tube that may be used is what is commonly referred to in the industry as a "boiler tube." The tubes may be composed of any material suitable for holding the pressurized steam and water up to 1750° F. and facilitating the transfer of thermal energy from the exhaust gases to the pressurized steam and water circulating within the tubes. Preferably, the tubes are composed of a metal such as carbon steel or stainless steel. It is presently preferred that the tubes be composed of ASTM A-178 Grade A Carbon Steel. While dimensions may vary depending on the desired flow rate, it is preferred that the tubes have a diameter in the range of one to three inches. For an HRSG capable of processing exhaust gases in the pressure range of 100 psig to 1,500 psig and of a temperature up to 1750° F., it is presently preferred that the tube have a diameter of two inches. Additionally, it is preferred that the tubes have a length in the range of eight to twelve feet, or as necessary to interconnect a corresponding pair of first and second manifolds. For an HRSG capable of processing exhaust gases in the pressure range of 100 psig to 1,500 psig and of a temperature up to 1750° F., it is presently preferred that the tubes span the height of the interior of the HRSG, or approximately thirteen feet.

Any number of tubes may be used to interconnect a corresponding pair of first and second manifolds. The number of tubes used may vary depending on the desired flow rate and amount of steam generation. Preferably, the number of tubes used to interconnect a corresponding pair of first and second manifolds is in the range of one tube to twenty-four tubes. For an HRSG capable of processing exhaust gases in the pressure range of 100 psig to 1,500 psig and of a temperature up to 1750° F., it is presently preferred that each pair of first and second manifolds be interconnected by eighteen tubes, each of which is equally spaced across the length of the first and second manifolds. The plurality of tubes interconnecting a corresponding pair of first and second manifolds is commonly referred to in the industry as a "platen assembly."

The tubes may be provided with a finned surface comprising a plurality of fins extending radially from an outer surface of the tube. Thermal energy from the exhaust gases is transferred through the fins and tubes. The water circulating through the tubes absorbs the thermal energy, which converts a portion of the water into steam. The fins may be composed of any material suitable for exposure to exhaust gases having a temperature up to 1750° F. and capable of transferring the thermal energy from the exhaust gases to the pressurized steam and water circulating within the tubes. Preferably, the fins are composed of a metal such as carbon steel or stainless steel. It is presently preferred that the fins be composed of ASTM A-36 Carbon Steel. Because of galvanic corrosion, the fins preferably are of the same material as the tubes or of a material that does not corrode with the tubes. It is presently preferred that the fins be composed of the same material as the tubes.

The fins may be of any length as necessary to allow the fins to transfer the thermal energy from the hot exhaust gases to the water circulating through the tubes. It is presently preferred that the fins have a length in the range of one-half to three-quarters of an inch. Shorter length fins are preferably placed on tubes closer to the inlet of the HRSG, where temperatures of the exhaust gases are hotter, up to 1750° F. Longer length fins are preferably placed on tubes deeper within the HRSG, where temperatures of the exhaust gases are cooler. The longer length fins have greater surface area, which allows for a more uniform heat absorption across the entire HRSG despite the decreasing temperatures of the exhaust gases.

The ratio of the fin length to the radius of the corresponding tube to which the fin is attached varies depending on the length of the fin and the radius of the tube. It is presently preferred that the fins have a length in the range of one-half to three-quarters of an inch and that the tubes have a diameter in the range of one to three inches. Considering these ranges, it is preferred that the ratio of fin length to tube radius be in the range of 1:3 to 1.5:1. For an HRSG capable of processing exhaust gases in the pressure range of 100 psig to 1,500 psig and of a temperature up to 1750° F., it is presently preferred that the ratio of fin length to tube radius be 0.5:1.

The fins may be of any shape as necessary to allow the fins to transfer the thermal energy from the hot exhaust gases to the water circulating through the tubes. Examples of fin shapes that allow for adequate heat transfer include rectangular or rectilinear and triangular-shaped fins. Fins also may be disc or annular-shaped, extending radially from an outer surface of the tubes. It is presently preferred that the fins be rectilinear-shaped and extend radially from an outer surface of the tube.

The fins may be arranged on the tubes in any manner that allows the fins to transfer the thermal energy from the hot exhaust gases to the water circulating through the tubes. For example, the fins may be arranged in a spiraling fashion along the circumference of the tube to form one continuous spiral along the length of the tube. As another example, the fins may be arranged in discrete rows along the length of the tube. Fins may be arranged along the circumference of the tubes such that adjacent fins are aligned in a direction along the length of the tube. Alternatively, fins may be arranged along the circumference of the tubes such that adjacent fins are staggered or slightly offset from one another. Fins may be offset by as much as half a fin in either direction. While many arrangements of fins will allow for adequate heat transfer, it is presently preferred that fins be arranged in a spiraling fashion whereby adjacent fins be offset about half a fin from one another.

The direction of fins also may be varied such that fins are aligned in a direction either perpendicular to or parallel with the length of the tubes. It is presently preferred that fins extend radially from the tubes in a direction perpendicular to the length of the tubes.

For individual fins having a rectilinear shape, the fins may be of any width as necessary to allow the fins to transfer the thermal energy from the hot exhaust gases to the water circulating through the tubes. For individual fins having a rectilinear shape, it is presently preferred that the fins have a width in the range of one-eighth of an inch to one-half of an inch. For an HRSG capable of processing exhaust gases in the pressure range of 100 psig to 1,500 psig and of a temperature up to 1750° F., it is presently preferred that, for individual fins having a rectilinear shape, the fins have a width of one-quarter of an inch.

For individual fins extending radially from the outer surface of the tubes, the spacing between adjacent fins also may be varied. For example, fins may be spaced closely, such that there are six fins per inch along the circumference of the tube. As another example, fins may be spaced farther apart, such that there are only three fins per inch along the circumference of the tube. The spacing of fins may be varied depending on the location of the fins in the HRSG. For example, fins on tubes closer to the inlet of the HRSG preferably are spaced farther apart because of the higher temperatures of the exhaust gases near the inlet. As another example, fins on tubes farther from the inlet and deeper within the HRSG preferably are spaced closer together because of the diminishing temperatures of the exhaust gases across the length of the HRSG. For an HRSG capable of processing exhaust gases in the pressure range of 100 psig to 1,500 psig and of a temperature up to 1750° F., it is presently preferred that the fins on tubes near the inlet of the HRSG have a spacing of three fins per inch of tube circumference. Additionally, it is presently preferred that the fins deep within the HRSG opposite the inlet have a spacing of six fins per inch of tube circumference. In this manner, heat absorption by the fins across the length of the HRSG remains uniform.

The fins may be of any thickness as necessary to allow the fins to transfer the thermal energy from the hot exhaust gases to the water circulating through the tubes. Preferably, the fins are of a thickness in the range of one-thirty-second of an inch to one-half of an inch. For an HRSG capable of processing exhaust gases in the pressure range of 100 psig to 1,500 psig and of a temperature up to 1750° F., it is presently preferred that the fins have a thickness of one-sixteenth of an inch.

At least one shield is disposed between the first vessel and the second vessel to direct the hot process gases over the finned surfaces of the tubes. Preferably, a plurality of shields are disposed between the first and second vessels, each shield disposed between adjacent pairs of first and second manifolds. The shields prevent the exhaust gases from bypassing the tubes as the gases pass through the HRSG. The shields direct the exhaust gases past the tubes to ensure that the fins on the tubes are exposed to the thermal energy from the exhaust gases. The shields may be composed of any material suitable to withstand exposure to exhaust gases having temperatures up to 1750° F. Preferably, the shields are composed of a metal such as carbon steel or stainless steel. It is presently preferred that the shields be composed of ASTM A-36 Carbon Steel. The shields may be any suitable shape that allows the shields to fit within the HRSG and direct the exhaust gases without obstructing the tubes and fins. It is presently preferred that the shields be rectilinear in shape such that each shield extends between the first and second vessels and fits between adjacent pairs of first and second manifolds. One particular type of shield is what is commonly referred to in the industry as a "down comer shield."

At least one flow enhancer, or a second tube in fluid communication with the second manifold and the first vessel, may be provided for returning steam to the first vessel. The use of a flow enhancer prevents circulation of steam and water from stalling in the second manifold because of hotter temperatures. At least some of the steam passing through the second manifold is forced through the flow enhancer, which allows the steam to return to the first vessel without being trapped or slowed down by water.

The flow enhancer may connect with the second manifold at any point along the length of the second manifold. Preferably, the flow enhancer connects with the second manifold in the middle eighty percent of the second manifold. It is presently preferred that the flow enhancer connect with the second manifold in about the middle of the second manifold. In this configuration, the flow enhancer draws from about the middle of the second manifold, allowing for approximately equal flow rates of water and steam at either end of the second manifold.

A plurality of flow enhancers may be provided such that the plurality of flow enhancers extend from the first vessel to some or all of the second manifolds. Preferably, the HRSG has flow enhancers connected to some of the second manifolds. For an HRSG capable of processing exhaust gases in the pressure range of 100 psig to 1,500 psig and of a temperature up to 1750° F., it is presently preferred that the five manifolds closest to the inlet of the HRSG have flow enhancers, as it has been found that stalling is more likely to occur in the second manifolds closest to the inlet of the HRSG where temperatures are hotter, up to 1750° F.

Preferably, the flow enhancer comprises a tube extending from the first vessel and bending slightly downward for interconnection with the second manifold. Alternatively, the flow enhancer may comprise a pipe that extends from the first vessel and terminates in an elbow to allow for connection with the second manifold. The bend or elbow at the end of the flow enhancer that allows for connection with the second manifold may have any degree of curvature as necessary to allow for adequate connection. Preferably, the degree of curvature is within the range of forty-five to ninety degrees. It is presently preferred that the degree of curvature be about ninety degrees.

The flow enhancer may be composed of any material suitable for containing pressurized steam having a temperature up to 1750° F. Preferably, the flow enhancer is composed of a metal such as carbon steel or stainless steel. It is presently preferred that the flow enhancer be composed of ASTM A-516, Grade 70 Carbon Steel. Because of galvanic corrosion, it is presently preferred that the flow enhancer be composed of the same material as the second manifolds.

Attachment of the Fins:

The fins may be attached to the tubes in any manner that allows the fins to transfer the thermal energy from the exhaust gases to the water circulating through the tubes. While there are many ways in which the fins may be attached to the tubes, and this invention is not limited to any particular method, it is presently preferred that the fins be attached to the tubes in the following manner. During production of the HRSG, a long strip of material is notched to form the individual fins, and then the strip of material is attached to the tube in a spiraling manner. More specifically, the long strip of material is notched to form fins having a certain desired width and spacing. As described above, it is presently preferred to have a range of three to six fins per inch of strip material. The long strip of material is notched to form the fins using any conventional method. As an example, the fins may be formed by stamping the strip material. As another example, the fins may be formed by cutting each fin individually with any conventional tooling. The long strip of material is then attached to the tube such that the fins extend radially from the tube. The fins may be attached to the tube using any known fastener or means for attachment. As an example, the fins may be attached to the tube by welding the long strip of material to the tube. Preferably, the fins are attached using high frequency electric resistance welding (ERW). High frequency ERW may be performed on many conventional welding machines. An example of such a machine is the Thermo-Tool High Frequency Electric Resistance Welder. This particular type of welder receives the tube and slowly advances and turns the tube while simultaneously welding the long strip of material to the tube. The weld is a continuous bead such that an end of the fins is fully attached to the tube and there are no gaps or spaces between the fins and the tube. The long strip of material is attached to the tube in a spiraling manner along the length of the tube. Because the process is fully automated by the welder, the fins may be accurately placed on the tube such that there is equal spacing and offset, if any, between adjacent fins.

Operation:

In operation, hot exhaust gases having a temperature up to 1750° F. passes through the inlet of the HRSG. At least one shield directs the exhaust gases past the heat exchanging surfaces such as the tubes. The thermal energy from the exhaust gases is transferred by the fins to the water passing through the tubes, thereby heating the water circulating within the HRSG. The heat converts a portion of the circulating water into steam.

As the water travels through the tubes, the water absorbs the heat from the exhaust gases, thereby transforming into a mixture of steam and water. As the steam and water passes into the second manifold, a portion of the steam is forced into at least one flow enhancer, which allows the portion of steam to travel to the first vessel without being obstructed or slowed by the water.

Steam generated within the HRSG exits the first vessel via an outlet and may be fed into another process requiring steam power. Residual precipitate within the first vessel is returned to the second vessel for recirculation through the first manifold of the HRSG.

The use of fins allows the HRSG to generate steam in amounts comparable to many conventional heat recovery steam generators, though with fewer tubes. This reduction in the number of tubes significantly reduces the overall weight and size of the unit. Moreover, the reduced number of tubes reduces the amount of materials necessary for production, thereby reducing the overall production cost.

DETAILED DESCRIPTION OF THE PREFERRED EMBODIMENT

The present invention will now be described more fully with reference to the Figures in which the preferred embodiment of the present invention is shown. The subject matter of this disclosure may, however, be embodied in many different forms and should not be construed as being limited to the embodiment set forth herein.

Referring now to the drawings, wherein like reference numerals designate identical or corresponding parts throughout the several views, FIG. 1 shows a heat recovery steam generator ("HRSG") 10 having a housing 12. As shown in FIG. 1, HRSG 10 may be used downstream of one or more processes that generate exhaust gases having temperatures up to 1750° F. and moving in a direction as indicated by the arrow. As an example, HRSG 10 may be used downstream of a gas turbine, thermal oxidizer, fluid bed combustor, or incinerator, as represented by the housing 11 upstream of HRSG 10 in FIG. 1. The exhaust gas emitted from HRSG 10 may be further processed, such as being passed through a feedwater economizer or a process water heat exchanger, as represented by the housing 13 downstream of HRSG 10 in FIG. 1. Alternatively, the exhaust gas passing through HRSG 10 may be emitted directly to the atmosphere.

Figure 2:
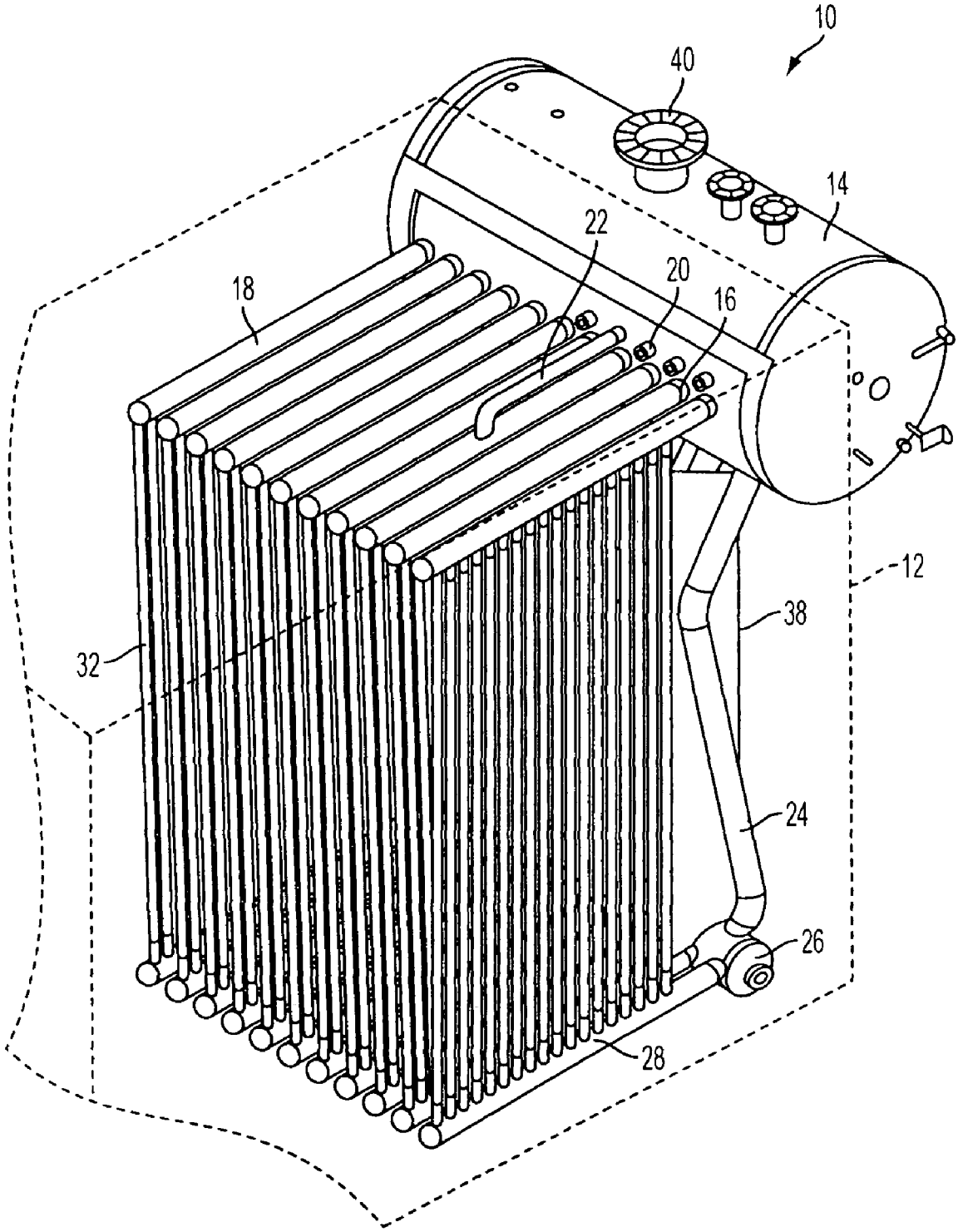
FIG. 2 is a perspective view of the heat recovery steam generator shown in FIG. 1.
Figure 3:
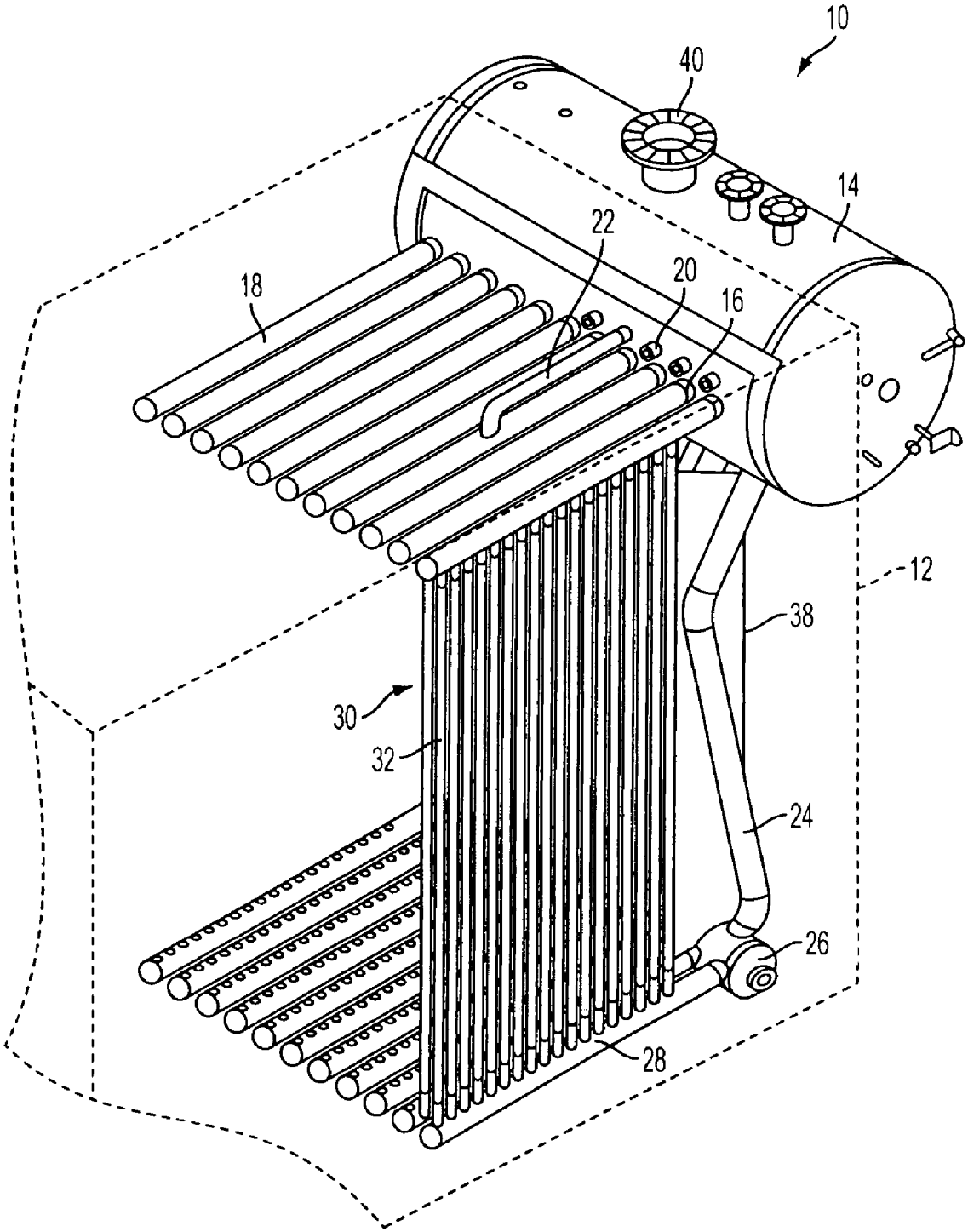
FIG. 3 is a perspective view of the heat recovery steam generator shown in FIG. 2 with some tubes removed for clarity.
Figure 4:
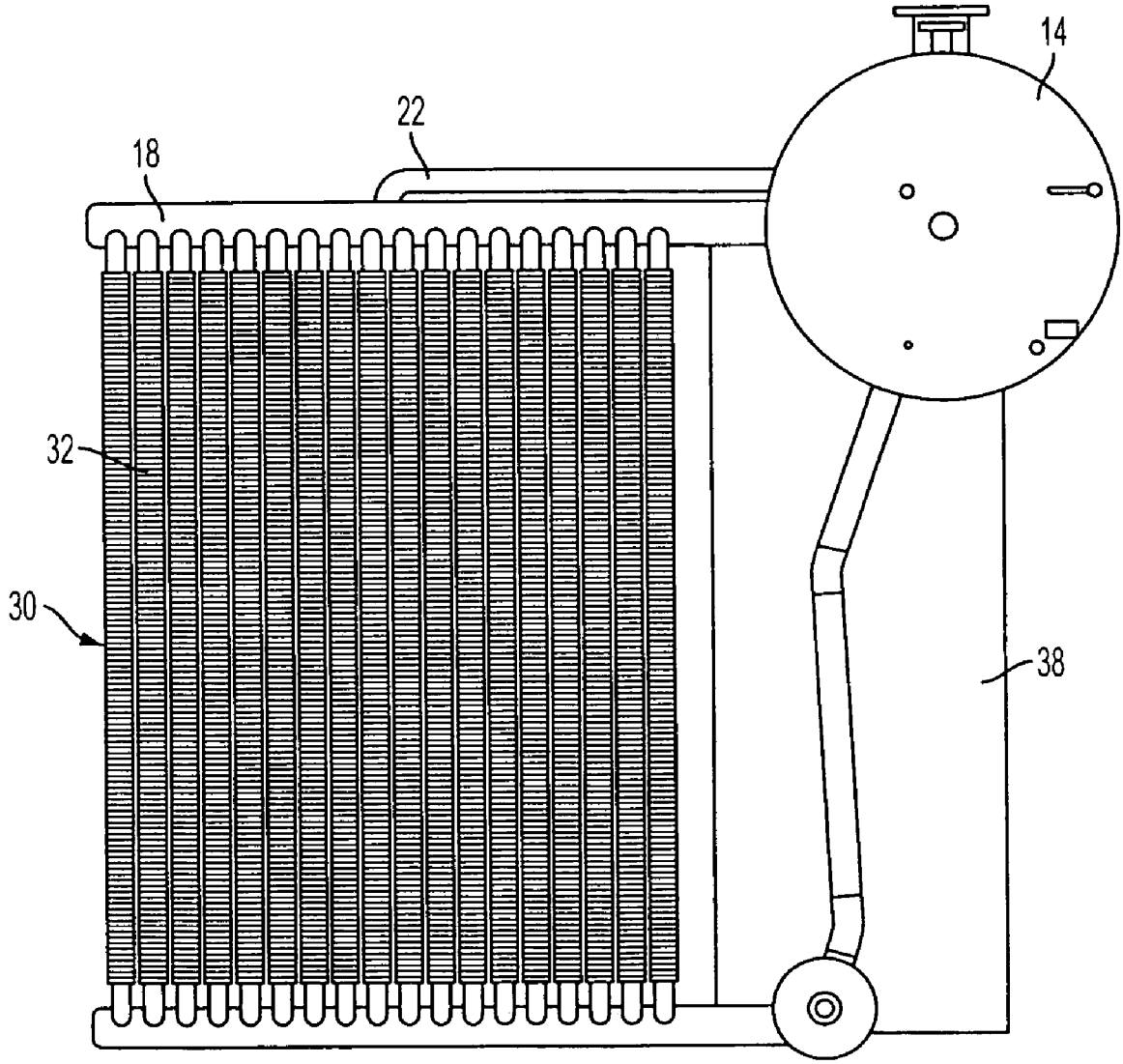
FIG. 4 is a side view of a heat recovery steam generator shown in FIG. 2.

FIGS. 2-4 show the various components of HRSG 10. Preferably, HRSG 10 is a "D" type, platen-style heat recovery steam generator, so-named because of the shape of the heat exchanging surfaces within HRSG 10. FIGS. 2 and 3 both show a perspective view of HRSG 10, except that many of the heat exchanging surfaces 30 and tubes 32 have been removed from view in FIG. 3 to better illustrate first manifolds 28. Additionally, the fins 34 have been removed from view in FIGS. 2 and 3 to better illustrate tubes 32. Fins 34 are shown in FIG. 4 and in greater detail in FIGS. 5-8.

First vessel 14, which holds the pressurized steam generated by the HRSG 10, resides within the housing 12 as shown in FIGS. 2 and 3. First vessel 14 has a plurality of first inlet ports 16 for interconnection with at least one manifold 18. Additionally, first vessel 14 has a plurality of second inlet ports 20 for interconnection with at least one flow enhancer 22. First vessel 14 is connected via a tube 24 to a second vessel 26, which holds the incoming water supply.

Manifolds 18 connect with the first vessel 14 and extend outwardly therefrom, as shown in FIGS. 2-4. Additionally, manifolds 28 connect with the second vessel 26 and extend outwardly therefrom in parallel spaced relation to the upper manifolds 18. For an HRSG capable of processing exhaust gases in the pressure range of 100 psig to 1,500 psig and of a temperature up to 1750° F., HRSG 10 preferably has eleven first manifolds 28 and eleven second manifolds 18, although those skilled in the art will appreciate that any number of manifolds may be used.

Heat exchanging surfaces 30 connect with first manifold 28 and second manifold 18, as shown in FIGS. 2-4. The heat exchanging surfaces 30 comprise a plurality of tubes 32. For an HRSG capable of processing exhaust gases in the pressure range of 100 psig to 1,500 psig and of a temperature up to 1750° F., HRSG 10 preferably has eleven sets of heat exchanging surfaces 30, each comprising eighteen tubes 32, although those skilled in the art will appreciate that any number of tubes may be used.

At least one shield 38 is disposed between the first vessel 14 and the second vessel 26 and directs the exhaust gases over the finned surfaces 34 of the heat exchanging surfaces 30. The shield 38 prevents the exhaust gases from bypassing the heat exchanging surfaces 30 as the gases pass through the HRSG 10.

At least one flow enhancer 22 connects with ports 20 of the first vessel 14 and travels in parallel spaced relation with second manifolds 18, as best shown in FIGS. 2 and 3. Additionally, flow enhancer 22 connects with second manifold 18 to allow steam to travel from the second manifold 18 to the first vessel 14. Specifically, a portion of the steam passing through the second manifold 18 is forced through flow enhancer 22 and is travels to first vessel 14 without being obstructed or slowed by water. As shown in FIGS. 2 and 3, the flow enhancer 22 preferably comprises a tube extending from the first vessel 14 and bending slightly downward for interconnection with the second manifold 18. As shown in FIGS. 2-4, the flow enhancer 22 preferably connects with the second manifold 18 in about the middle of the manifold. For an HRSG capable of processing exhaust gases in the pressure range of 100 psig to 1,500 psig and of a temperature up to 1750° F., HRSG 10 preferably has flow enhancers 22 on the five heat exchanging surfaces 30 closest to the inlet of HRSG 10, as shown in FIGS. 2 and 3, although those skilled in the art will appreciate that any number of flow enhancers may be used. The use of the flow enhancer 22 prevents circulation of steam and water from stalling in the second manifolds 18, particularly in the heat exchanging surfaces 30 closer to the inlet of HRSG 10 where stalling is more likely to occur because of hotter temperatures.

Figure 5:
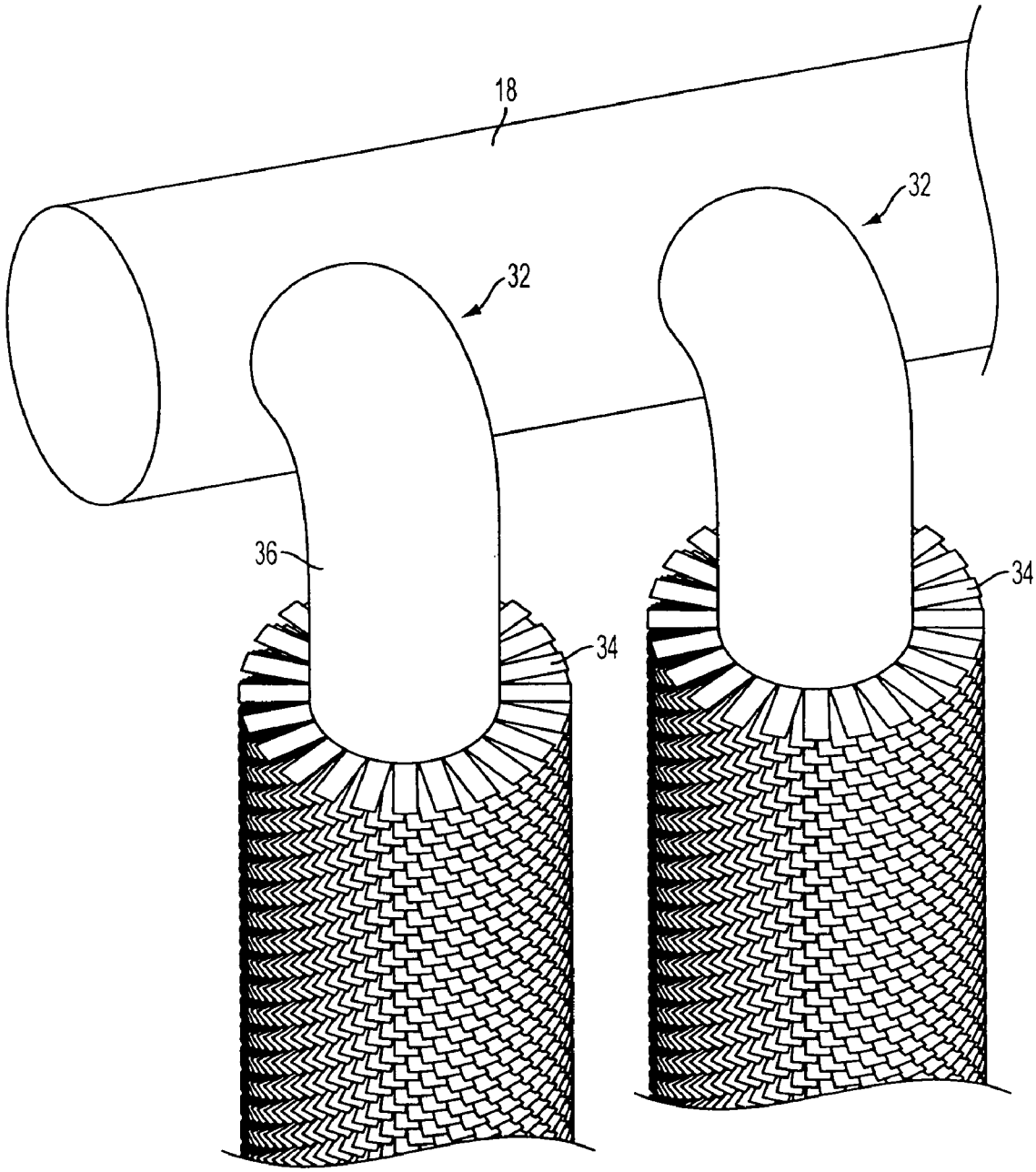
FIG. 5 is a perspective view of a tube of the heat recovery steam generator shown in FIG. 2.
Figure 7:
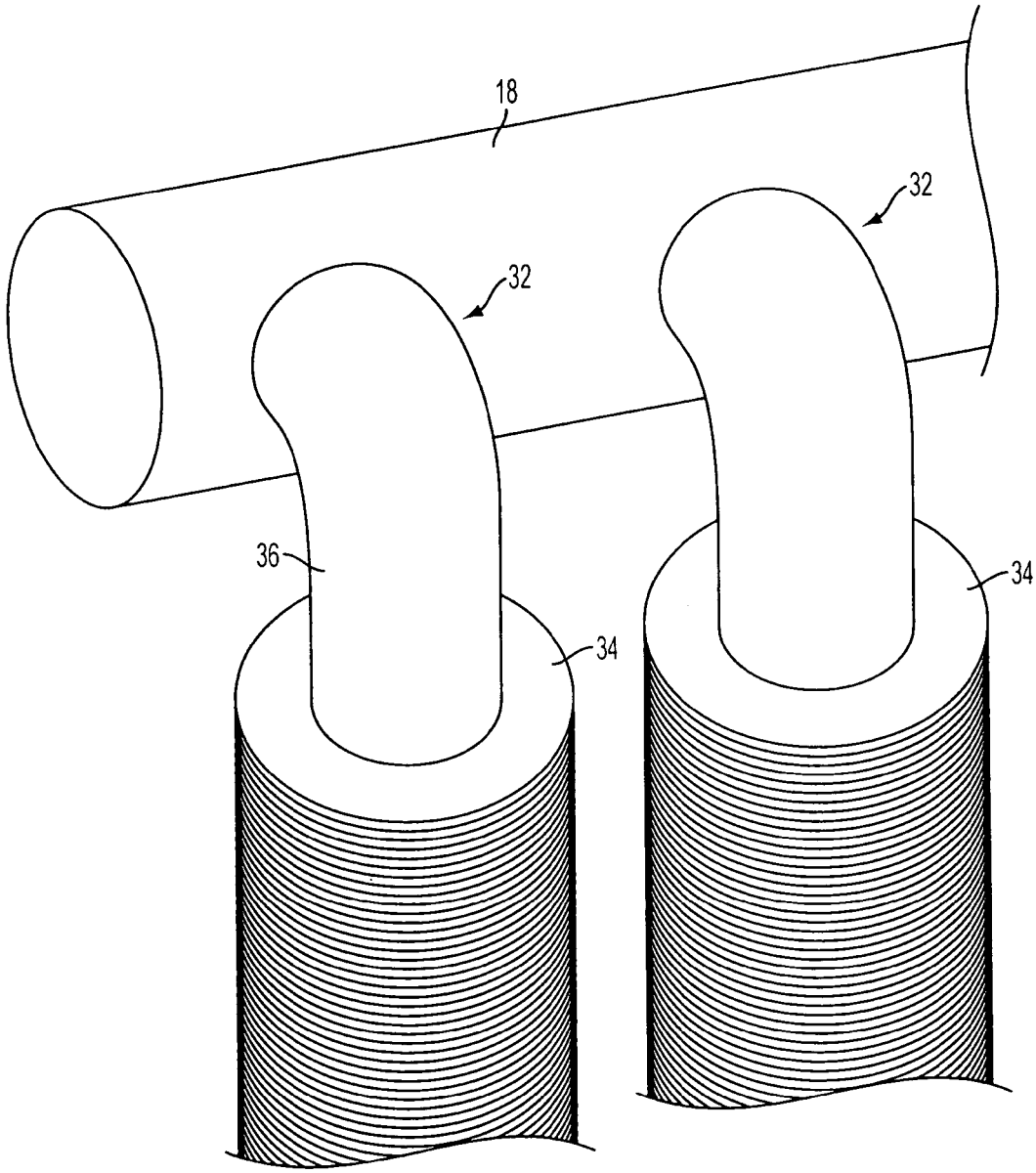
FIG. 7 is a perspective view of a tube of still another embodiment of the present invention.
Figure 8:
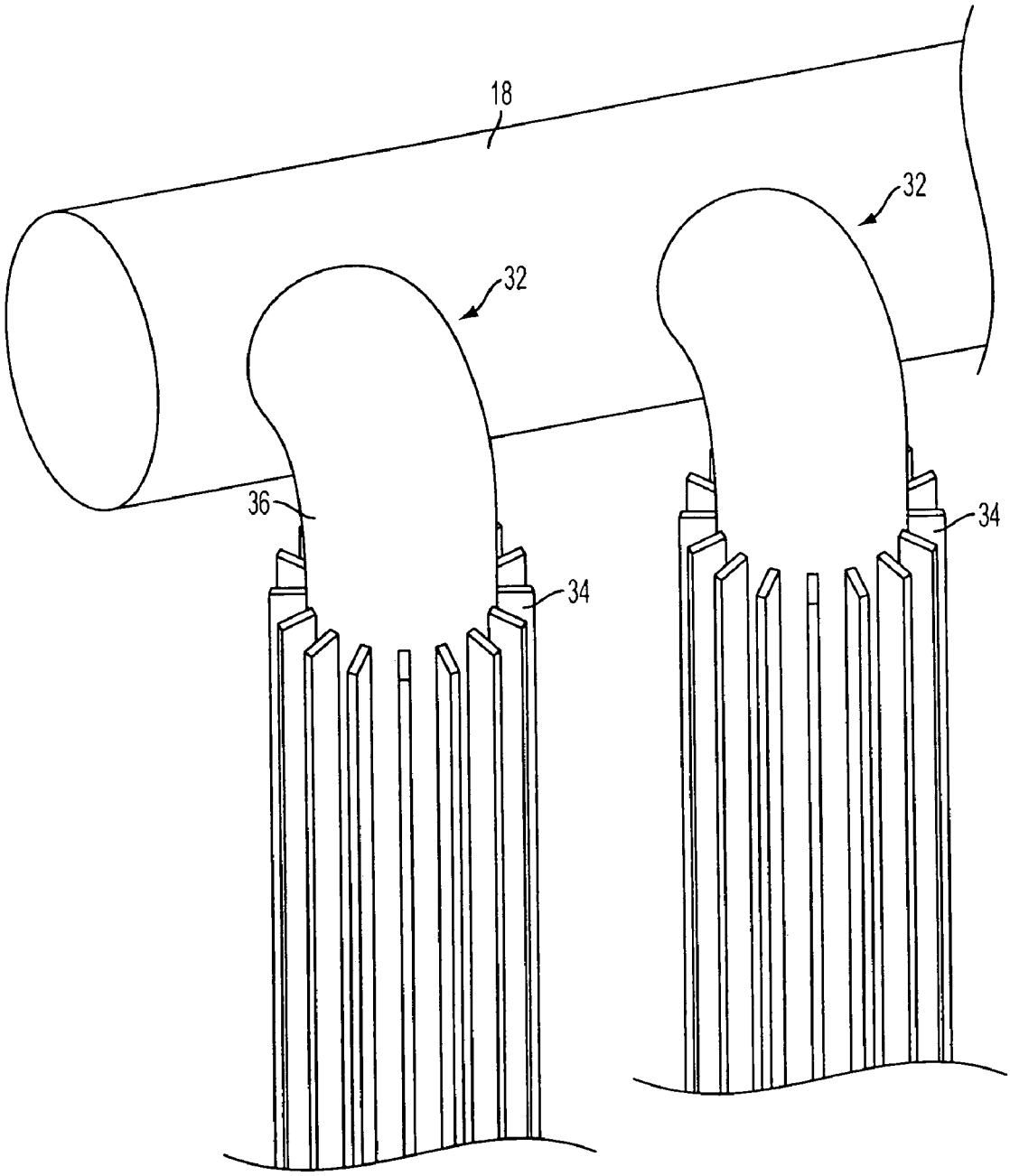
FIG. 8 is a perspective view of a tube of still a further embodiment of the present invention.

As shown in FIGS. 4 and 5, tubes 32 may be provided with a finned surface or plurality of individual fins 34 that extend radially from an outer surface or diameter 36 of the tubes. Thermal energy from the exhaust gases is transferred through the fins 34 and tubes 32. The water circulating through the tubes 32 absorbs the thermal energy, which converts a portion of the water into steam. FIG. 5 shows the fins 34 as presently preferred, while FIGS. 6-8 show various modifications of the fins 34.

As shown in FIG. 5, the fins 34 may be arranged in a spiraling fashion along the circumference or outer surface 36 of the tube 32 to form one continuous spiral along the length of the tube 32. Fins 34 may be arranged along the circumference of the tubes 32 such that adjacent fins are staggered or slightly offset from one another. Fins 34 may be offset by as much as half a fin in either direction. While many arrangements of fins will allow for adequate heat transfer, it is presently preferred that fins be arranged in a spiraling fashion whereby adjacent fins be offset about half a fin from one another.

As shown in FIG. 5, the spacing between adjacent fins 34 also may be varied. For example, fins 34 may be spaced closely, such that there are six fins per inch along the circumference of the tube 32. As another example, fins 34 may be spaced farther apart, such that there are only three fins per inch along the circumference of the tube 32. The spacing of fins 34 may be varied depending on the location of the fins in the HRSG 10. For example, fins 34 on tubes 32 closer to the inlet of the HRSG preferably are spaced farther apart because of the higher temperatures of the exhaust gases near the inlet. As another example, fins on tubes farther from the inlet and deeper within the HRSG preferably are spaced closer together because of the diminishing temperatures of the exhaust gases across the length of the HRSG. For an HRSG capable of processing exhaust gases in the pressure range of 100 psig to 1,500 psig and of a temperature up to 1750° F., it is presently preferred that the fins 34 on tubes 32 near the inlet of the HRSG 10 have a spacing of three fins per inch of tube circumference. Additionally, it is presently preferred that the fins 34 deep within the HRSG 10 opposite the inlet have a spacing of six fins per inch of tube circumference. In this manner, heat absorption by the fins 34 across the length of the HRSG 10 remains uniform.

Figure 6:
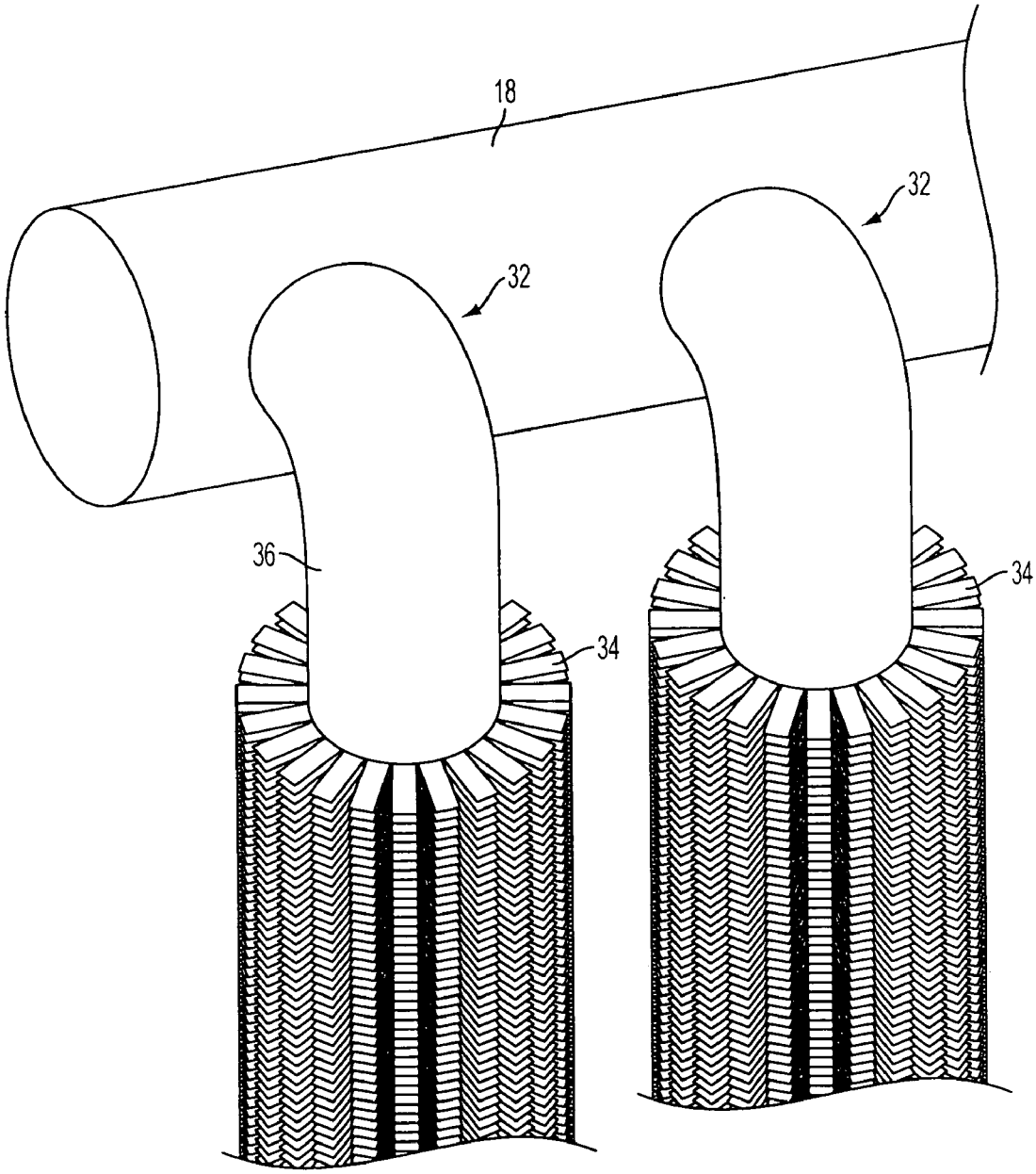
FIG. 6 is a perspective view of a tube of another embodiment of the present invention.

As shown in FIG. 6, the fins 34 may be arranged in discrete rows along the length of the tube 32. Fins 34 may be arranged along the circumference of the tubes 32 such that adjacent fins are aligned in a direction along the length of the tube 32.

As shown in FIG. 7, the fins 34 may be of any shape as necessary to allow the fins 34 to transfer the thermal energy from the hot exhaust gases to the water circulating through the tubes 32. Fins 34 may be disc or annular-shaped, extending radially from an outer surface of the tubes, as shown in FIG. 7. It is presently preferred that the fins 34 be rectilinear-shaped and extend radially from an outer surface of the tube 32, as shown in FIG. 5.

As shown in FIG. 8, the direction of fins 34 also may be varied such that fins are aligned in a direction parallel with the length of the tubes 32. It is presently preferred that fins 34 extend radially from the tubes 32 in a direction perpendicular to the length of the tubes 32, as shown in FIG. 5.

The fins 34 may be attached to the tubes 32 in any manner that allows the fins 34 to transfer the thermal energy from the exhaust gases to the water circulating through the tubes 32. While there are many ways in which the fins 34 may be attached to the tubes, and this invention is not limited to any particular method, it is presently preferred that the fins be attached to the tubes in the following manner. During production of the HRSG 10, a long strip of material is notched to form the individual fins, and then the strip of material is attached to the tube in a spiraling manner. More specifically, the long strip of material is notched to form fins having a certain desired width and spacing. It is presently preferred to have a range of three to six fins per inch of strip material. The long strip of material is notched to form the fins using any conventional method. As an example, the fins may be formed by stamping the strip material. As another example, the fins may be formed by cutting each fin individually with any conventional tooling. The long strip of material is then attached to the tube such that the fins extend radially from the tube. The fins 34 may be attached to the tube 32 using any known fastener or means for attachment. As an example, the fins 34 may be attached to the tube 32 by welding the long strip of material to the tube. Preferably, the fins 34 are attached using high frequency electric resistance welding (ERW). High frequency ERW may be performed on many conventional welding machines. An example of such a machine is the Thermo-Tool High Frequency Electric Resistance Welder. This particular type of welder receives the tube 32 and slowly advances and turns the tube while simultaneously welding the long strip of material to the tube. The weld is a continuous bead such that an end of the fins 34 is fully attached to the tube 32 and there are no gaps or spaces between the fins and the tube. The long strip of material is attached to the tube in a spiraling manner along the length of the tube. Because the process is fully automated by the welder, the fins 34 may be accurately placed on the tube 32 such that there is equal spacing and offset, if any, between adjacent fins.

In operation, hot exhaust gases enter the HRSG 10 and pass through the housing 12. At least one shields 38 directs the exhaust gases past the heat exchanging surfaces 30. The thermal energy from the exhaust gases is transferred by the fins 34 on the outer surface 36 of the tubes 32 to the water circulating with the tubes 32, thereby heating the water circulating within the HRSG 10 and converting a portion of the water into steam.

Specifically, water contained within the second vessel 26 circulates through manifolds 28 and into the heat exchanging surfaces 30. As the water travels through the tubes 32, the water absorbs the heat from the exhaust gases, thereby transforming into a mixture of steam and water. As the steam and water passes into manifolds 18, a portion of the steam is forced into at least one flow enhancer 22, which increases the flow of steam into the first vessel 14.

Steam generated within the HRSG 10 exits the first vessel 14 via outlet 40 and may be fed into another process requiring steam power. Residual precipitate within the first vessel 14 is returned to the second vessel 26 via pipe 24.

Because of the use of the finned surfaces 34 on the tubes 32 of the heat exchanging surfaces 30, the HRSG 10 is capable of generating between 5,000 and 300,000 pounds per hour of saturated or superheated steam. The use of fins 34 allows the HRSG 10 to generate steam in amounts comparable to many conventional heat recovery steam generators, though with fewer boiler tubes 32, which significantly reduces the overall weight and size of the unit. Because of the decreased weight and size, the HRSG 10 is capable of being shipped over the road, which significantly reduces shipping costs. The use of fewer tubes 32 also significantly decreases the manufacturing costs associated with the HRSG 10.

Many changes and modifications will occur to those skilled in the art upon studying this specification. All such changes and modifications which fall within the appended claims or within the spirit of the invention are intended to be included within the scope of the claim.

What is claimed is:

1. A heat recovery steam generator comprising:

a first vessel for holding a mixture of steam and water;

at least one first manifold in fluid communication with the first vessel, the at least one first manifold for receiving water recirculated through the first vessel;

at least one horizontal inlet port in the side of said first vessel;

at least one second manifold in fluid communication with the first vessel and in parallel spaced relation to the first manifold, one end of said at least one second manifold directly connected to said at least one horizontal inlet port and extending horizontally outwardly from said at least one horizontal inlet port, the at least one second manifold for returning recirculated water received by said at least one first manifold from said first vessel as a mixture of steam and water via the said at least one horizontal inlet port to the first vessel for separation into steam and recirculated water;

at least one first tube in fluid communication with the at least one first manifold and the at least one second manifold; and a plurality of fins extending radially outward from an outer surface of the at least one first tube.

2. The heat recovery steam generator of claim 1 wherein the fins are of a length in the range of one-half to three-quarters of an inch.

3. The heat recovery steam generator of claim 1 wherein the ratio of fin length to tube radius is in the range of 1:3 to 1.5:1.

4. The heat recovery steam generator of claim 1 wherein the fins are rectilinear in shape and extend radially from the tube in a direction perpendicular to the length of the tube.

5. The heat recovery steam generator of claim 4 wherein the fins are of a width in the range of one-eighth to one-half of an inch.

6. The heat recovery steam generator of claim 4 wherein adjacent fins are spaced in a spiraling fashion along the circumference of the tube.

7. The heat recovery steam generator of claim 6 wherein adjacent fins are spaced in the range of three to six fins per inch of tube circumference.

8. The heat recovery steam generator of claim 6 wherein adjacent fins are aligned.

9. The heat recovery steam generator of claim 6 wherein adjacent fins are offset.

10. The heat recovery steam generator of claim 9 wherein the fins are offset by as much as half a fin.

11. The heat recovery steam generator of claim 1 wherein the fins are rectilinear in shape and extend radially from the tube in a direction parallel to the length of the tube.

12. The heat recovery steam generator of claim 1 wherein the fins are annular-shaped and extend radially from the tube.

13. The heat recovery steam generator of claim 1 further comprising a second vessel in fluid communication with the first vessel, the second vessel for holding water from an incoming water supply.

14. The heat recovery steam generator of claim 1 wherein the at least one first manifold, the at least one second manifold, and the at least one tube are disposed in a housing.

15. The heat recovery steam generator of claim 1 wherein a plurality of first and second manifolds are in fluid communication with the first vessel.

16. The heat recovery steam generator of claim 15 wherein eleven first manifolds and eleven second manifolds are in fluid communication with the first vessel.

17. The heat recovery steam generator of claim 1 wherein a plurality of tubes extend between the at least one first manifold and the at least one second manifold.

18. The heat recovery steam generator of claim 17 wherein eighteen tubes extend between the at least one first manifold and the at least one second manifold.

19. The heat recovery steam generator of claim 1 wherein the first vessel is a steam drum.

20. The heat recovery steam generator of claim 1 wherein the first vessel is partially filled about halfway with water.

21. A heat recovery steam generator comprising:

a first vessel for holding a mixture of steam and water;

at least one first manifold in fluid communication with the first vessel, the at least one first manifold for receiving water from the first vessel;

at least one second manifold in fluid communication with the first vessel and in parallel spaced relation to the first manifold, one end of said at least one second manifold directly connected to an inlet port in the side of said first vessel, said at least one second manifold extending horizontally outwardly therefrom, the at least one second manifold for returning a mixture of steam and water via the said connection to the first vessel;

at least one first tube in fluid communication with the at least one first manifold and the at least one second manifold; and at least one second tube in fluid communication with the at least one second manifold and a second inlet port in the side of said first vessel, the at least one second tube for returning steam to the first vessel.

22. The heat recovery steam generator of claim 21 wherein the at least one second tube extends from the first vessel and has a bend for connection with the second manifold.

23. The heat recovery steam generator of claim 22 wherein the bend has a curvature in the range of forty-five and ninety degrees.

24. The heat recovery steam generator of claim 22 wherein the at least one second tube connects with the second manifold in the middle eighty percent of the second manifold.

25. The heat recovery steam generator of claim 22 wherein the at least one second tube connects with the second manifold in about the middle of the second manifold.

26. The heat recovery steam generator of claim 21 wherein the at least one second tube comprises a pipe extending from the first vessel and terminating in an elbow for connection with the second manifold.

27. The heat recovery steam generator of claim 21 further comprising a plurality of fins extending radially outward from an outer surface of the at least one first tube.

28. The heat recovery steam generator of claim 27 wherein the fins are of a length in the range of one-half to three-quarters of an inch.

29. The heat recovery steam generator of claim 27 wherein the ratio of fin length to tube radius is in the range of 1:3 to 1.5:1.

30. The heat recovery steam generator of claim 27 wherein the fins are rectilinear in shape and extend radially from the tube in a direction perpendicular to the length of the tube.

31. The heat recovery steam generator of claim 30 wherein the fins are of a width in the range of one-eighth to one-half of an inch.

32. The heat recovery steam generator of claim 30 wherein adjacent fins are spaced in a spiraling fashion along the circumference of the tube.

33. The heat recovery steam generator of claim 32 wherein adjacent fins are spaced in the range of three to six fins per inch of tube circumference.

34. The heat recovery steam generator of claim 32 wherein adjacent fins are aligned.

35. The heat recovery steam generator of claim 32 wherein adjacent fins are offset.

36. The heat recovery steam generator of claim 35 wherein the fins are offset by as much as half a fin.

37. The heat recovery steam generator of claim 27 wherein the fins are rectilinear in shape and extend radially from the tube in a direction parallel to the length of the tube.

38. The heat recovery steam generator of claim 27 wherein the fins are annular-shaped and extend radially from the tube.

39. A heat recovery steam generator comprising:

(a) a first vessel for holding a mixture of steam and water;

(b) a plurality of first manifolds in fluid communication with said first vessel, each of said plurality of first manifolds for receiving water from said first vessel;

(c) A plurality of second manifolds in fluid communication with said first vessel and in parallel spaced relation to said plurality of first manifolds, one end of each said plurality of second manifolds being directly connected to a corresponding inlet port in the side of said first vessel, said plurality of second manifolds extending horizontally outwardly therefrom, said plurality of second manifolds for returning a mixture of steam and water via said corresponding inlet ports to said first vessel;

(d) a plurality of finned tubes in fluid connection with each of said plurality of first manifolds and each of said plurality of second manifolds, said plurality of finned tubes for receiving heat from hot exhaust gases passing over said plurality of finned tubes;

(e) optionally, at least one flow enhancing tube in fluid communication between at least one of said plurality of second manifolds and a corresponding second entry port in the side of said first vessel, said at least one flow enhancing tube for returning steam to said first vessel, said at least one flow enhancing tube connecting to the top of said at least one of said plurality of second manifolds within about the middle eighty percent of said at least one of said plurality of second manifolds;

(f) at least one shield for directing hot exhaust gases across said plurality of finned tubes.

40. A heat recovery steam generator comprising:

a first vessel for holding a mixture of steam and water;

at least one first manifold in fluid communication with the first vessel, the at least one first manifold for receiving water from the first vessel;

at least one second manifold in fluid communication with the first vessel and in parallel spaced relation to the first manifold, one end of said at least one second manifold directly connected to an inlet port in the side of said first vessel, said at least one second manifold extending horizontally outwardly therefrom, the at least one second manifold for returning a mixture of steam and water via the said connection to the first vessel;

at least one first tube in fluid communication with the at least one first manifold and the at least one second manifold;

a plurality of fins extending radially outward from an outer surface of the at least one first tube; and at least one second tube in fluid communication with the at least one second manifold and the first vessel, the at least one second tube for returning steam to the first vessel.

41. The heat recovery steam generator of claim 40 wherein the at least one second tube extends from the first vessel and has a bend for connection with the second manifold.

42. The heat recovery steam generator of claim 41 wherein the bend has a curvature in the range of forty-five and ninety degrees.

43. The heat recovery steam generator of claim 41 wherein the at least one second tube connects with the second manifold in the middle eighty percent of the second manifold.

44. The heat recovery steam generator of claim 41 wherein the at least one second tube connects with the second manifold in about the middle of the second manifold.

45. The heat recovery steam generator of claim 41 wherein the at least one second tube comprises a pipe extending from the first vessel and terminating in an elbow for connection with the second manifold.

46. The heat recovery steam generator of claim 40 further comprising at least one shield disposed within the housing for directing hot exhaust gases across the at least one tube.

47. The heat recovery steam generator of claim 46 wherein the shield is rectilinear in shape and extends between the at least one first manifold and the at least one second manifold.

* * * * *